US005128588A

United States Patent [19]

Kameya et al.

[11] Patent Number: 5,128,588

[45] Date of Patent: Jul. 7, 1992

[54] DISCHARGE LAMP WITH MOLYBDENUM SEALING FOILS

[75] Inventors: Takayuki Kameya, Ohmiya; Hiroshi Ishizaki; Akihiro Hashiguchi, both of Urawa, all of Japan

[73] Assignee: Koto Electric Co., Ltd., Saitama, Japan

[21] Appl. No.: 645,630

[22] Filed: Jan. 25, 1991

[30] Foreign Application Priority Data

Jan. 29, 1990 [JP] Japan ..... 2-6161[U]

[51] Int. Cl.[5] ..... H01J 61/36

[52] U.S. Cl. ..... 313/623; 313/332

[58] Field of Search ..... 313/332, 623

[56] References Cited

U.S. PATENT DOCUMENTS

| | | | |
|---|---|---|---|
| 2,876,377 | 3/1959 | Retzer et al. | 313/623 |
| 3,675,068 | 7/1972 | Strauss | 313/332 X |
| 4,559,472 | 12/1985 | Triebel et al. | 313/623 |
| 4,673,843 | 6/1987 | Okanuma | 313/623 X |
| 5,025,192 | 6/1991 | Okamoto | 312/623 |

FOREIGN PATENT DOCUMENTS

| | | | |
|---|---|---|---|
| 899392 | 1/1954 | Fed. Rep. of Germany | 313/332 |

*Primary Examiner*—Palmer C. DeMeo

[57] ABSTRACT

A large output discharge lamp comprising rod-like electrodes having confronting ends defining therebetween the discharge gap and being disposed in a bulb body. The other ends of the electrodes extend sealingly into two oppositely extending side tube which are integrally formed with the bulb body. Molybdenum foils are connected respectively with the electrodes and disposed and sealed respectively in the side tubes. Flexible metal pieces are respectively connected with the molybdenum foils and are disposed in the side tubes and outwards of the molydenum foils. Lead rods are connected respectively with the flexible metal pieces through molybdenum cups and disposed in the side tubes. The outer end portions of the side tubes are sealed and bases are respectively mounted thereon which are connected to the lead rods respectively.

3 Claims, 1 Drawing Sheet

DISCHARGE LAMP WITH MOLYBDENUM SEALING FOILS

BACKGROUND OF THE INVENTION

1. Field of the Invention

This invention relates generally to a discharge lamp and, particularly, to the construction of a high output discharge lamp for illuminating an outdoor or indoor studio and the like and having superior cooler rendering property.

2. Description of the Prior Art

For illuminating an outdoor studio and the like, a metal halide discharge lamp has commonly been utilized for its high output and superior color rendering property. Such a metal halide discharge lamp requires the presence of various elements in its discharge space. The light emitted from the lamp consists of the luminous spectrum of these elements. These elements are usually filled in the lamp bulb as bulb as halide and, act such that they dissociate in between the discharge gap, generate the luminous spectrum in receiving the collision energy of the electron. The elements move toward the low temperature zone in the bulb and are formed as the molecule of halide. An amount of heat corresponding to the difference in the electro-negativity (the energy required for coupling) is emitted as heat. The phenomenon is repeated again and again and, is observed as a circulation between the electric discharge zone between the electrodes and the low temperature zone at size tube portions of the bulb. Such circulation can be expressed that the energy generated as luminous spectrum in the discharge zone is converted into the energy in the zone wherein the molecular halide moves toward the low temperature zone.

When the energy conversion is not properly performed, the intensity of the light and the color rendering property are affected. Further, the luminous output decreases due to the dielectric loss, the electrodes will be damaged and the wall of the bulb may be melted and pierced. Further, in discharge lamps other than the metal halide discharge lamp, there is also a tendency for loss in overheating of the electrodes and of the molybdenum foil acting as a sealing member.

The discharge lamp usually comprises rod-like electrodes formed usually of Tungsten rods having confronting ends defining therebetween the discharge gap, molybdenum foils connected respectively with the electrodes and being sealed from the atmosphere, and lead terminals connected respectively with the molybdenum foils and extending outwards of the bulb body. The portions connecting respectively the molybdenum foils with the lead terminals are usually disposed in the atmosphere. Thus, the foils will be contaminated and deteriorated due to the high temperature and be ruptured.

For preventing the deterioration of the molybdenum foils, the length of the sealing portion of prior art molybdenum foils has been elongated so as to increase the heat conductive resistance and to restrict the temperature of the molybdenum foils below the recrystallization temperature. However, in the large output discharge lamp, the electric resistance increases due to the elongated length of the molybdenum foil sealing portion, which induces a rise in temperature and accelerates the deterioration such as by a brittle rupture.

SUMMARY OF THE INVENTION

An object of the present invention is to provide a discharge lamp which solves the above described shortcomings in a prior art discharge lamp due to the sealing portions in the large output discharge lamp.

According to the invention, there is provided a large output discharge lamp comprising rod-like electrodes having confronting ends defining therebetween the discharge gap and being disposed in a bulb body, the other ends of said electrodes extending into two oppositely extending side tubes integrally formed with said bulb body, molybdenum foils connected respectively with the electrodes and being disposed and sealed respectively in the side tubes, flexible metal pieces respectively connected with the molybdenum foils and disposed in the side tubes, lead rods connected respectively with the flexible metal pieces through molybdenum cups and disposed in the side tubes, sealing portions sealing the outer end portions of the side tubes, and bases respectively disposed on the outer ends of the side tubes and connected to the lead rods respectively.

The rod-like electrodes preferably formed of Tungsten according tot he invention are connected respectively with molybdenum foils at locations in the side tubes and near to the bulb body with the molybdenum foils being sealed in the side tubes, and the molybdenum foils are connected respectively with the flexible metal pieces such as twisted or braided cord-like metal ribbon such as copper having good thermal and electrical conductivity. Thus, the heat of the molybdenum foils is conducted to the metal pieces and is cooled, and the expansion or the contraction due to the heat is absorbed by the flexibility of the metal pieces, and the side tubes will not be deformed. The lead rods connected to the metal strips are soldered to molybdenum cups respectively, and the molybdenum cups are sealingly connected to the side tubes of the discharge lamp respectively through fuzed quartz. The interior of the side tubes receiving therein the flexible and good electroconductivity metal pieces is under reduced pressure and the temperature is sufficiently reduced. Thus, the molybdenum foils will not be contaminated and deteriorated by a brittle rupture.

The above and other features and advantages of the present invention and the manner of utilizing them will become more apparent, and the invention itself will best be understood, from the following description with reference to the attached drawings showing a preferred embodiment of the invention.

BRIEF DESCRIPTION OF THE DRAWING

The present invention will become more fully understood from the detailed description give hereinbelow and the accompanying drawings which are given by way of illustration only, and thus are not limitative of the present invention, and wherein.

DESCRIPTION OF THE PREFERRED EMBODIMENT

Figure 1:
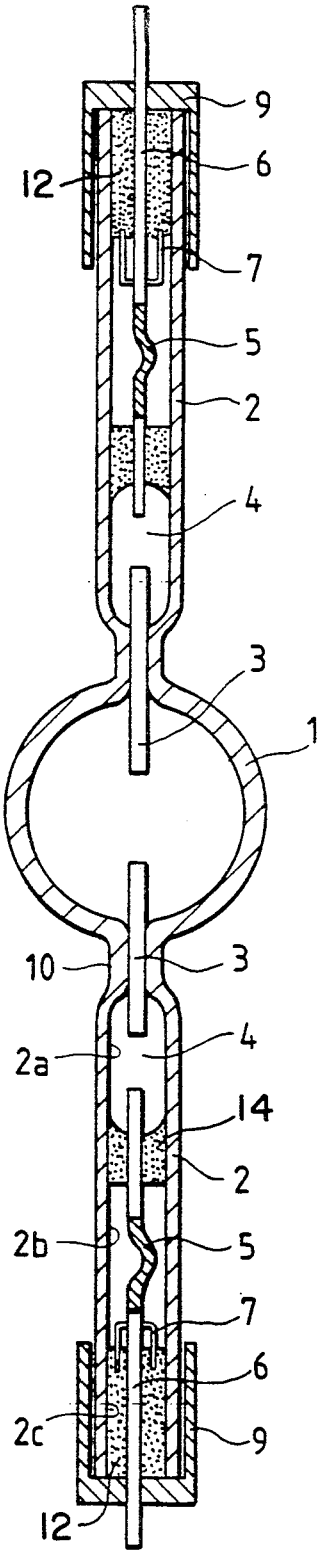
FIG. 1 is a longitudinal section of a discharge lamp according to an embodiment of the present invention.
Figure 2:
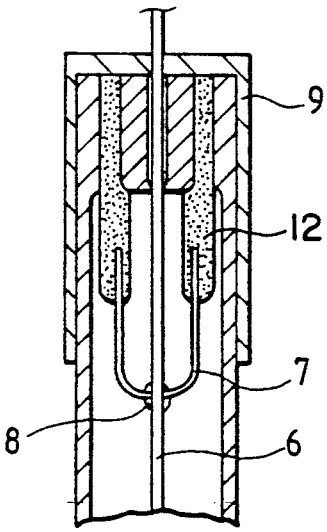
FIG. 2 is an enlarged sectional view of a molybdenum cup sealing portion of the discharge lamp of FIG. 1.

Referring to FIG. 1, a discharge lamp according to the invention comprises a generally spherical lamp body 1 defining therein a lamp space, and two side tubes 2 opposingly extending from opposite sides of the lamp body 1 and integrally formed with the lamp body. Rod-like electrodes 3 formed preferably of Tungsten rods are disposed in the side tubes 2 respectively and the inner ends thereof project into the lamp body and define the discharge gap therebetween. Each rod-like electrode 3 is connected with a molybdenum foil 4 and is pinch sealed by corresponding side tube 2 as shown at numeral 10. Each molybdenum foil 4 is connected through silica glass 14 with flexible metal piece 5 preferably formed of twisted or braided cord-like metal ribbon such as copper because of tis good thermal and electrical conductivity. Thus, the heat of the molybdenum foil 4 is conducted to the metal piece 5 and is cooled, and the expansion or the contraction due to the heat is absorbed by the flexibility of the metal piece 5. Accordingly the side tubes 2 will not be deformed. The metal strips 5 are connected respectively with lead rods 6. The lead rods 6 are respectively connected by soldering 8, for example with molybdenum cups 7 and are pierced therethrough. As shown in FIG. 2, each molybdenum cup 7 is sealingly connected to the outer end portion of the side tube 2 through quartz glass 12 attached thereto with a flared portion thereof being turned up outward and sealingly connected to the inner wall of the side tube 2. A base 9 is mounted on the outer end of the side tube 2 and connected to the lead rod 6.

The molybdenum foil 4 connected to the rod-like electrode 3 transmits the heat generated by the electric discharge directly to the metal piece 5. Thus, the temperature of the molybdenum foil does not rise excessively. Further, the interior of the side tube 2 is under reduced pressure, and the molybdenum foil 4 and the metal piece 5 do not contact with atmosphere and the brittle rupture of the molybdenum foil 4 can be prevented.

In a usual metal halide discharge lamp, the discharge space in the lamp is filled with an inert gas, mercury and various halide, and the discharge lamp according to the invention is not limited to such metal halide discharge lamps but can also be applied to other discharge lamps such as a xenon discharge lamp, a high pressure mercury lamp and the like and, similar advantages can be attained.

As described heretofore, the discharge lamp according to the invention comprises rod-like electrodes 3 and 3 having confronting ends defining therebetween the discharge gap and being disposed in a bulb body. The other ends of the electrodes 3 and 3 extend into two oppositely extending side tubes 2 and 2 integrally formed with the bulb body. Zones 2*a* receive molybdenum foils 4 and 4 which are connected respectively with the electrodes 3 and 3 and are respectively disposed and sealed in the side tubes 2 and 2. Zones 2*b* receive flexible metal pieces 5 and 5 which are connected with the molybdenum foils 4 and 4 respectively and disposed in the side tubes 2. Zones 2*c* receive lead rods 6 which are respectively connected with the flexible metal pieces 5 and 5 through molybdenum cups 7 and disposed in the side tubes. Zones 2*c* sealingly connect the flexible and good electro-conductive lead rod 6 respectively through molybdenum cups 7, and bases 9 are provided on the outer ends of the side tubes 2. Thus, the heat generated from the electric discharge is instantly dissipated through the molybdenum foils and the flexible and heat conductive metal pieces. Further the molybdenum foils do not contact atmospheric air and the brittle rupture of the molybdenum foils can be prevented. Accordingly, the molybdenum foils will not be contaminated and deteriorated such as by a brittle rupture.

Therefore, the service life of the metal halide discharge lamp which has been restricted by the brittle rupture of the molybdenum foils can be elongated by at least twice that of the standardized life.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed:

1. A large output discharge lamp comprising rod-like electrodes having confronting ends defining therebetween the discharge gap and being disposed in a bulb body, the other ends of said electrodes extending into two oppositely extending side tubes integrally formed with said bulb body, molybdenum foils connected respectively with the electrodes and being disposed and air-tightly sealed respectively in the side tubes, flexible metal pieces respectively connected with the molybdenum foils and disposed in the side tubes, lead rods connected respectively with the flexible metal pieces through molybdenum cups and disposed in the side tubes, sealing portions sealing both the inner and outer end portions of the side tubes, and bases respectively disposed on the outer ends of the side tubes and connected to the lead rods respectively.

2. The discharge lamp according to claim 1, wherein zones in the side tubes receiving therein the molybdenum foils respectively are maintained under reduced pressure.

3. The discharge lamp according to claim 1, wherein the interior of the bulb body is free of direct contact with molybdenum, the molybdenum foils being connected to the electrodes disposed in the bulb body but otherwise avoiding communications with the interior of the bulb body.

* * * * *